US009595214B2

(12) United States Patent
Seo et al.

(10) Patent No.: US 9,595,214 B2
(45) Date of Patent: Mar. 14, 2017

(54) METHOD OF CONTROLLING DRIVING VOLTAGE OF DISPLAY PANEL AND DISPLAY APPARATUS PERFORMING THE METHOD

(71) Applicant: Samsung Display Co., LTD., Yongin, Gyeonggi-Do (KR)

(72) Inventors: Hee-Jeong Seo, Asan-si (KR); Jae-Ill Kim, Cheonan-si (KR); Jong-Min Shim, Gangneung-si (KR); Ji-Young Lee, Asan-si (KR); Seung-Hwan Cheong, Cheonan-si (KR); Eui-Myeong Cho, Anyang-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 225 days.

(21) Appl. No.: 14/313,101

(22) Filed: Jun. 24, 2014

(65) Prior Publication Data

US 2015/0187317 A1 Jul. 2, 2015

(30) Foreign Application Priority Data

Dec. 30, 2013 (KR) ..... 10-2013-0167297

(51) Int. Cl.
*G09G 3/00* (2006.01)

(52) U.S. Cl.
CPC ..... *G09G 3/006* (2013.01); *G09G 2310/0289* (2013.01); *G09G 2330/026* (2013.01)

(58) Field of Classification Search
CPC ..... G09G 3/006; G09G 3/36; G09G 3/3611; G09G 3/3674–3/3681; G09G 2310/0264; G09G 2310/0267; G09G 2310/0289; G09G 2310/08; G09G 2330/02; G09G 2330/026; G09G 2330/12
See application file for complete search history.

(56) References Cited

U.S. PATENT DOCUMENTS

| | | | | |
|---|---|---|---|---|
| 6,795,152 | B2 | 9/2004 | Tsai | |
| 7,714,590 | B2 | 5/2010 | Jow et al. | |
| 8,330,484 | B2 | 12/2012 | Wong | |
| 2003/0141878 | A1 | 7/2003 | Shinzou et al. | |
| 2007/0182440 | A1 * | 8/2007 | Cha | G09G 3/3611 324/760.01 |

(Continued)

FOREIGN PATENT DOCUMENTS

| | | |
|---|---|---|
| KR | 0906963 | 7/2009 |
| KR | 1020110091369 A | 8/2011 |

*Primary Examiner* — Nathan Danielsen
(74) *Attorney, Agent, or Firm* — Cantor Colburn LLP

(57) ABSTRACT

A method of controlling a driving voltage of a display apparatus includes transmitting a ready signal from a timing control circuit of the display apparatus to a power management circuit of the display apparatus through a connection area of a connection member of the display apparatus, which is disposed between a display panel and a main circuit board of the display apparatus, and controlling a generation of the driving voltage from the power management circuit based on the ready signal received by the power management circuit, where the display apparatus includes a gate driver circuit disposed on the display panel, and the timing control circuit and the power management circuit are disposed on the main circuit board.

20 Claims, 6 Drawing Sheets

(56) References Cited

U.S. PATENT DOCUMENTS

| | | | | |
|---|---|---|---|---|
| 2008/0225036 | A1* | 9/2008 | Song | G09G 3/3611 345/213 |
| 2009/0167742 | A1* | 7/2009 | Nakagawa | G09G 3/3688 345/211 |
| 2011/0204910 | A1 | 8/2011 | Suto | |
| 2013/0201171 | A1* | 8/2013 | Song | G09G 3/20 345/212 |

* cited by examiner

METHOD OF CONTROLLING DRIVING VOLTAGE OF DISPLAY PANEL AND DISPLAY APPARATUS PERFORMING THE METHOD

This application claims priority to Korean Patent Application No. 10-2013-0167297 filed on Dec. 30, 2013, and all the benefits accruing therefrom under 35 U.S.C. §119, the content of which in its entirety is herein incorporated by reference.

BACKGROUND

1. Field

Exemplary embodiments of the invention relate to a method of controlling a driving voltage of a display apparatus and a display apparatus that performs the method. More particularly, example embodiments of the invention relate to a method of controlling a driving voltage for protecting a gate driver circuit of the display apparatus and a display apparatus that performs the method.

2. Description of the Related Art

Generally, a liquid crystal display ("LCD") device includes an LCD panel that displays an image using a light-transmitting ratio of liquid crystal molecules, and a backlight assembly disposed below the LCD panel to provide the LCD panel with light.

The LCD device includes a display panel in which a plurality of pixel parts connected to gate lines and data lines crossing the gate lines are formed, a gate drive circuit outputting a gate signal to the gate lines, and a data drive circuit outputting a data signal to the data lines. The gate drive circuit and the data drive circuit may be formed in a chip type, and may be formed on the display panel. A pixel includes a pixel electrode and a thin film transistor. The thin film transistor is connected to a data line, a gate line and the pixel electrode, and drives the pixel electrode. Generally, the thin film transistor includes an active layer having amorphous silicon.

In order to decrease a total size of a gate drive circuit and to reduce the size of an LCD and to simplify the manufacture of the LCD, a process in which the gate driving circuit is integrated on the LCD panel has been developed. The gate drive circuit includes a thin film transistor which is formed via that is process substantially the same as that for forming the thin film transistor of the pixel.

SUMMARY

Exemplary embodiments of the invention provide a method of controlling a driving voltage for protecting a gate driver circuit.

Exemplary embodiments of the invention provide a display apparatus performing the method of controlling the driving voltage.

According to an exemplary embodiment of the invention, a method of controlling a driving voltage of a display apparatus includes transmitting a ready signal from a timing control circuit of the display apparatus to a power management circuit of the display apparatus through a connection area of a connection member of the display apparatus, which is disposed between a display panel and a main circuit board of the display apparatus, and controlling a generation of the driving voltage from the power management circuit based on the ready signal received by the power management circuit, where the display apparatus includes a gate driver circuit disposed on the display panel, the timing control circuit is disposed on the main circuit board, and the power management circuit is disposed on the main circuit board.

In an exemplary embodiment, the method may further include generating the driving voltage from the power management circuit during an error detection period when the ready signal received by the power management circuit is in a high level, and generating a clock signal of the gate driver circuit from the power management circuit using the driving voltage.

In an exemplary embodiment, the method may further include providing the gate driver circuit with the clock signal, feeding back the clock signal to the power management circuit from the gate driver circuit, determining whether an error occurs in the gate drive circuit using the clock signal fed back to the power management circuit and controlling the generation of the driving voltage from the power management circuit based on a determination on whether the error occurs.

In an exemplary embodiment, the method may further include non-generating the driving voltage from the power management circuit when the ready signal received by the power management circuit is in a low level.

In an exemplary embodiment, the display apparatus may further include a data connection member which is connected to the display panel and is configured to generate a data signal, a circuit board which is connected to the data connection member, and a circuit connection member which is connected to the a circuit board and the main a circuit board, where the ready signal may pass through a connection area of the circuit connection member.

In an exemplary embodiment, the display apparatus may further include a data connection member which connects the display panel and the main circuit board and is configured to generate a data signal, where the ready signal may pass through a connection area of the data connection member.

According to an exemplary embodiment of the invention, a method of controlling a driving voltage of a display apparatus includes generating a connection detection signal from a main board of the display apparatus, transmitting the connection detection signal to a power management circuit of the display apparatus through a connection area of a connection member which is disposed between a display panel and the main circuit board of the display apparatus, and controlling a generation of the driving voltage from the power management circuit based on the connection detection signal received by the power management circuit, where the display apparatus includes a gate driver circuit disposed on the display panel, and the power management circuit is disposed on the main circuit board.

In an exemplary embodiment, the method may further include generating the driving voltage from the power management circuit during an error detection period when the connection detection signal by the power management circuit is in a high level and generating a clock signal of the gate driver circuit from the power management circuit using the driving voltage.

In an exemplary embodiment, the method may further include providing the gate driver circuit with the clock signal, feeding back the clock signal to the power management circuit from the gate driver circuit, determining whether an error occurs in the gate drive circuit using the clock signal fed back to the power management circuit, and controlling the generation of the driving voltage based on a determination on whether the error occurs.

In an exemplary embodiment, the method may further include non-generating the driving voltage, when the connection detection signal received by the power management circuit is in a low level.

According to an exemplary embodiment of the invention, a display apparatus includes a display panel; a gate driver circuit disposed on the display panel, a main circuit board including a timing control circuit disposed therein and a power management circuit board disposed therein, and a connection member disposed between the display panel and the main circuit board, where the power management circuit receives the ready signal from the timing control circuit through a connection area of the connection member and controls a generation of the driving voltage based on the ready signal received thereby.

In an exemplary embodiment, when the ready signal received by the power management circuit is in a high level, the power management circuit may generate the driving voltage and generate a clock signal of the gate driver circuit using the driving voltage, during an error detection period.

In an exemplary embodiment, the power management circuit may provide the gate driver circuit with the clock signal, feed back the clock signal from the gate driver circuit, determine whether an error occurs in the gate drive circuit using the clock signal being fed back thereto, and control the generation of the driving voltage based on a determination on whether the error occurs.

In an exemplary embodiment, the power management circuit may not generate the driving voltage, when the ready signal received by the power management circuit is in a low level.

In an exemplary embodiment, the display apparatus may further include a data connection member which is connected to the display panel and is configured to generate a data signal, a circuit board which is connected to the data connection member and a circuit connection member which is connected to the circuit board and the main circuit board, where the ready signal may pass through a connection area of the circuit connection member.

In an exemplary embodiment, the display apparatus may further include a data connection member which connects the display panel and the main circuit board and is configured to generate a data signal, where the ready signal may pass through a connection area of the data connection member.

According to an exemplary embodiment of the invention, a display apparatus includes a display panel; a gate driver circuit disposed on the display panel, a main circuit board including a power management circuit disposed therein, and a connection member disposed between the display panel and the main circuit board, where the power management circuit generates a driving voltage to drive the display panel and a connection detection signal, transmits the connection detection signal thereto through a connection area of the connection member and controls a generation of the driving voltage based on the connection detection signal received thereby.

In an exemplary embodiment, when the connection detection signal received by the power management circuit is in a high level, the power management circuit may generate the driving voltage and generate a clock signal of the gate driver circuit using the driving voltage, during an error detection period.

In an exemplary embodiment, the power management circuit may provide the gate driver circuit with the clock signal, feed back the clock signal from the gate driver circuit, determine whether an error occurs in the gate drive circuit using the clock signal being fed back thereto, and control the generation of the driving voltage based on a determination on whether the error occurs.

In an exemplary embodiment, the power management circuit may not to generate the driving voltage, when the connection detection signal received by the power management circuit is in a low level.

According to exemplary embodiments of the invention, a connection state between the main circuit board, the connection member and the data connection member may be detected using a predetermined signal, and a process for detecting the error of the gate driver circuit is performed only when the connection state is a normal state. Thus, when the connection state is in an abnormal state, the process for detecting the error of the gate driver circuit is not performed such that the gate driver circuit may be prevented from being damaged by performing the process for detecting the error in the abnormal state.

BRIEF DESCRIPTION OF THE DRAWINGS

The above and other features of the invention will become more apparent by describing in detailed exemplary embodiments thereof with reference to the accompanying drawings, in which.

DETAILED DESCRIPTION

Figure 1:
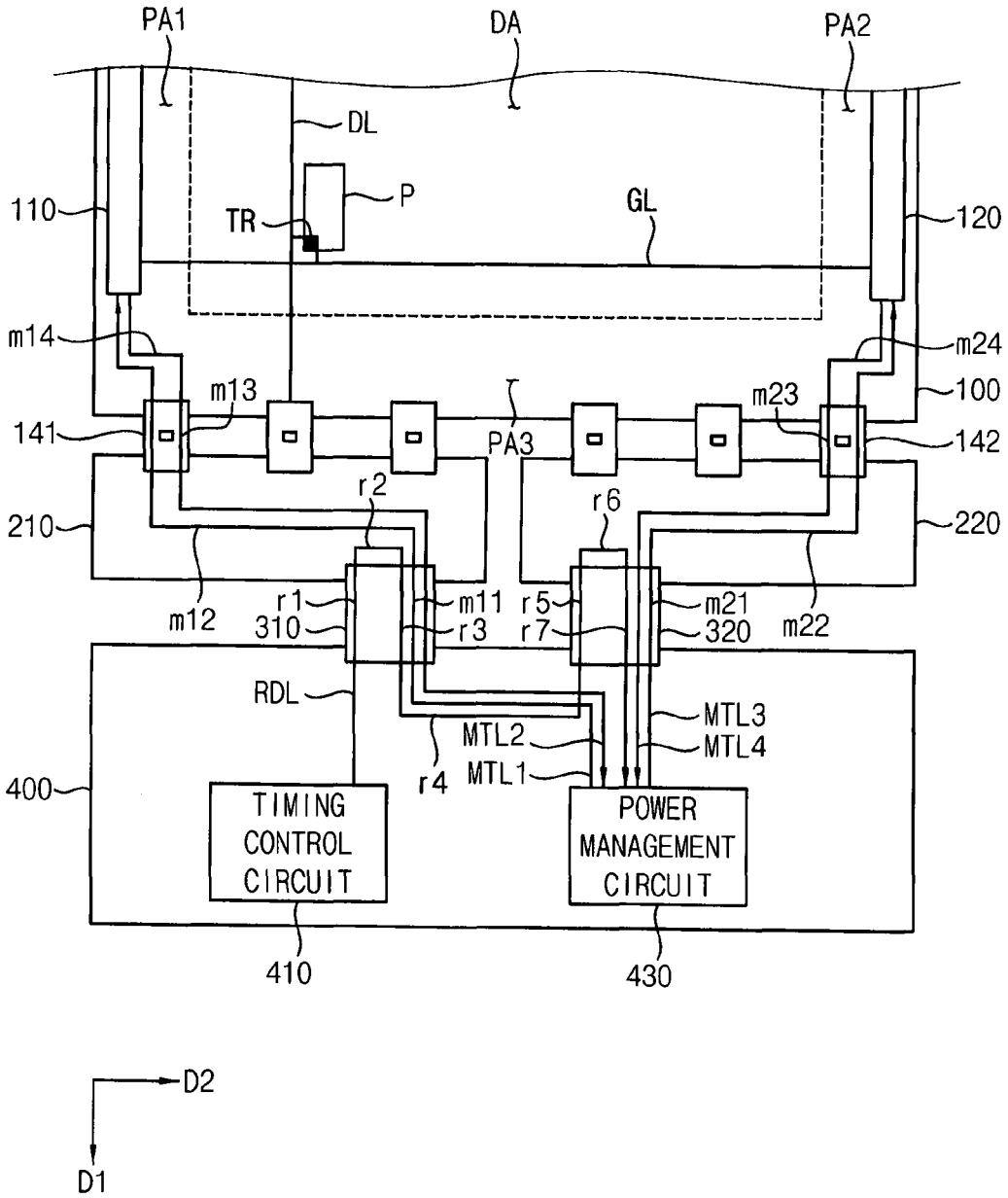
FIG. 1 is a block diagram illustrating an exemplary embodiment of a display apparatus according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Hereinafter, exemplary embodiments of the invention will be described in detail with reference to the accompanying drawings.

FIG. 1 is a block diagram illustrating an exemplary embodiment of a display apparatus according to the invention.

Referring to FIG. 1, an exemplary embodiment of the display apparatus may include a display panel 100, a plurality of data connection members 141 and 142, a plurality of circuit boards 210 and 220, a plurality of circuit connection members 310 and 320 and a main circuit board 400.

The display panel 100 may include a display area DA and a plurality of peripheral areas PA1, PA2 and PA3 surrounding the display area DA.

The display panel 100 includes a plurality of data lines DL, a plurality of gate lines GL and a plurality of pixels P, which are disposed in the display area DA.

The data lines DL extend substantially in a first direction D1 and are arranged substantially in a second direction DL2 crossing the first direction D1. The gate lines GL extend substantially in the second direction D2 and are arranged substantially in the first direction D1. The pixels P are arranged substantially in a matrix form and each of the pixels P includes a pixel transistor TR which is connected to a corresponding data line of the data lines DL and a corresponding gate line of the gate lines GL.

The display apparatus may include a first gate driver circuit 110 disposed in or integrated on a first peripheral area PA1. The first gate driver circuit 110 is connected to a first end portion of the gate lines, and is configured to provide the gate lines GL with a plurality of gate signals. In an exemplary embodiment, the first gate driver circuit 110 includes a plurality of transistors which is directly provided or formed in the first peripheral area PA1 through a same process as a process for providing the pixel transistor TR.

The display apparatus may include a second gate driver circuit 120 disposed in or integrated on a second peripheral area PA2. The second gate driver circuit 120 is connected to a second end portion of the gate lines GL and is configured to provide the gate lines GL with a plurality of gate signals. In an exemplary embodiment, the second gate driver circuit 120 includes a plurality of transistors which is directly provided or formed in the second peripheral area PA2 through a same process as the process for providing the pixel transistor TR.

The plurality of data connection members 141 and 142 is disposed in a third peripheral area PA3.

The plurality of data connection members 141 and 142 are configured to provide the data lines DL with a plurality of data signals.

The plurality of data connection members may be a type of tape packages, such as a tape carrier package ("TCP"), for example. A first data connection member 141, which is adjacent to the first gate driver circuit 110 among the plurality of data connection members 141 and 142, transfers a driving signal to the first gate driver circuit 110. A second data connection member 142, which is adjacent to the second gate driver circuit 120 among the plurality of data connection members 141 and 142, transfers a driving signal to the second gate driver circuit 120.

The plurality of circuit boards 210 and 220 is connected to the plurality of data connection members 141 and 142. The plurality of circuit boards 210 and 220 includes a first circuit board 210 connected to a first group of the data connection members and configured to provide the first group of the data connection members with the driving signal, and a second circuit board 210 connected to a second group of the data connection members and configured to provide the second group of the data connection members with the driving signal.

The plurality of circuit connection members 310 and 320 is connected to the plurality of circuit boards 210 and 220. The plurality of circuit connection members 310 and 320 includes a first circuit connection member 310 connected to the first circuit board 210 and configured to provide the first circuit board 210 with the driving signal, and a second circuit connection member 320 connected to the second circuit board 220 and configured to provide the second circuit board 220 with the driving signal.

The main circuit board 400 includes a timing control circuit 410 and a power management circuit 430 which are disposed therein.

The timing control circuit 410 is configured to generate a plurality of timing signals based on an original control signal. The timing signals includes a plurality of data timing signals to drive the plurality of data connection members 141 and 142 and a plurality of gate timing signal to drive the first and second gate driver circuits 110 and 120. The data timing signals may include a vertical synchronization signal, a horizontal synchronization signal, a data clock signal, a load signal and so on, for example. The gate timing signals may include a vertical start signal, a clock control signal and so on, for example. The timing control circuit 410 may be configured to correct the data signals using various compensation algorithms and to provide the plurality of data connection members with corrected data signals.

In an exemplary embodiment, when the display apparatus is turned on, e.g., in a power-on state, the timing control circuit 410 is configured to provide the power management circuit 430 with the ready signal in a high level to inform a ready state of an operation thereof. The ready signal is transmitted or transferred to the power management circuit 430 through a ready signal line RDL.

In such an embodiment, the ready signal line RDL includes a first portion r1 which passes through a first area of connection areas of the first circuit connection member 310, a second portion r2 which is disposed in a first area of the first circuit board 210, a third portion r3 which passes through a second area of the connection areas of the first circuit connection member 310, a fourth portion r4 which is disposed in a first area of the main circuit board 400, a fifth portion r5 which passes through a first area of connection areas of the second circuit connection member 320, a sixth portion r6 which is disposed in a first area of the second circuit board 220 and a seventh portion r7 which passes through a second area of the connection areas of the second circuit connection member 320. In such an embodiment, the connection area of the first or second circuit connection member 310 or 320 may be defined at opposing ends thereof. As described above, in such an embodiment, the ready signal line RDL passes through all connection areas of the first and second circuit connection members 310 and 320.

In such an embodiment, when the ready signal in a high level is received at the power management circuit 430, the power management circuit 430 substantially performs an operation thereof. Thus, the power management circuit 430 generates a plurality of driving voltages and the plurality of clock signals using the plurality of driving voltages. In such an embodiment, when the ready signal in a low level is received at the power management circuit 430, the power management circuit 430 substantially does not perform the operation, and thus does not generate the plurality of driving voltages and the plurality of clock signals.

In one exemplary embodiment, for example, the plurality of driving voltages may include a plurality of data driving voltages to drive the data connection members and a plurality of gate driving voltages to drive the first and second gate driver circuits 110 and 120. The data driving voltage may include an analog source voltage, a digital source voltage and so on, for example. The gate driving voltages may include a gate-on voltage and a gate-off voltage.

In such an embodiment, the power management circuit 430 is configured to generate a plurality of clock signals which controls the first and second gate driver circuits 110 and 120, using the gate-on voltage and the gate-off voltage.

The power management circuit 430 is configured to generate a first monitoring signal, which is configured to detect an error of the first gate driver circuit 110, and to generate second monitoring signal, which is configured to detect an error of the second gate driver circuit 120. The first and second monitoring signals may be referred to as a clock signal.

The power management circuit 430 is configured to provide the first and second gate driver circuits 110 and 120 with the first and second monitoring signals during an error detection period, and then to receive the first and second monitoring signals fed back from the first and second gate driver circuits 110 and 120 and to thereby determine whether an error occurs in the first and second gate driver circuits 110 and 120.

The first monitoring signal is applied to the first gate driver circuit 110 through a first monitoring signal line MTL1. The first monitoring signal fed back from the first gate driver circuit 110 is received at the power management circuit 430 through a second monitoring signal line MTL2.

The second monitoring signal is applied to the second gate driver circuit 120 through a third monitoring signal line MTL3. The second monitoring signal fed back from the second gate driver circuit 120 is received at the power management circuit 430 through a fourth monitoring signal line MTL4.

Each of the first and second monitoring signal lines MTL1 and MTL2 includes a first portion m11 which passes through a third area of the connection areas of the first circuit connection member 310, a second portion m12 which is disposed in a second area of the first circuit board 210, a third portion m13 which passes through a first area of connection areas of the first data connection member 141 and a fourth portion m14 which is disposed in the third peripheral area PA3 and is connected to the first gate driver circuit 110. In such an embodiment, the connection area of the first circuit or data connection member 310 or 141 may be defined at opposing ends thereof.

Each of the third and fourth monitoring signal lines MTL3 and MTL4 includes a first portion m21 which passes through a third area of the connection areas of the second circuit connection member 320, a second portion m22 which is disposed in a second area of the second circuit board 220, a third portion m23 which passes through a first area of connection areas of the second data connection member 142 and a fourth portion m24 which is disposed in the third peripheral area PA3 and is connected to the second gate driver circuit 120. In such an embodiment, the connection area of the second circuit or data connection member 320 or 142 may be defined at opposing ends thereof.

The power management circuit 430 may detect whether a connection error occurs between the plurality of circuit connection members 310 and 320 and the main circuit board 400, using the ready signal outputted from the timing control circuit 410. In one exemplary embodiment, for example, when the power management circuit 430 receives the ready signal in the high level, the power management circuit 430 determines that a connection state between the plurality of circuit connection members 310 and 320 and the main circuit board 400 is a normal state. In such an embodiment, when the power management circuit 430 receives the ready signal in the low level, the power management circuit 430 determines that the connection state between the plurality of circuit connection members 310 and 320 and the main circuit board 400 is an abnormal state.

Figure 2:
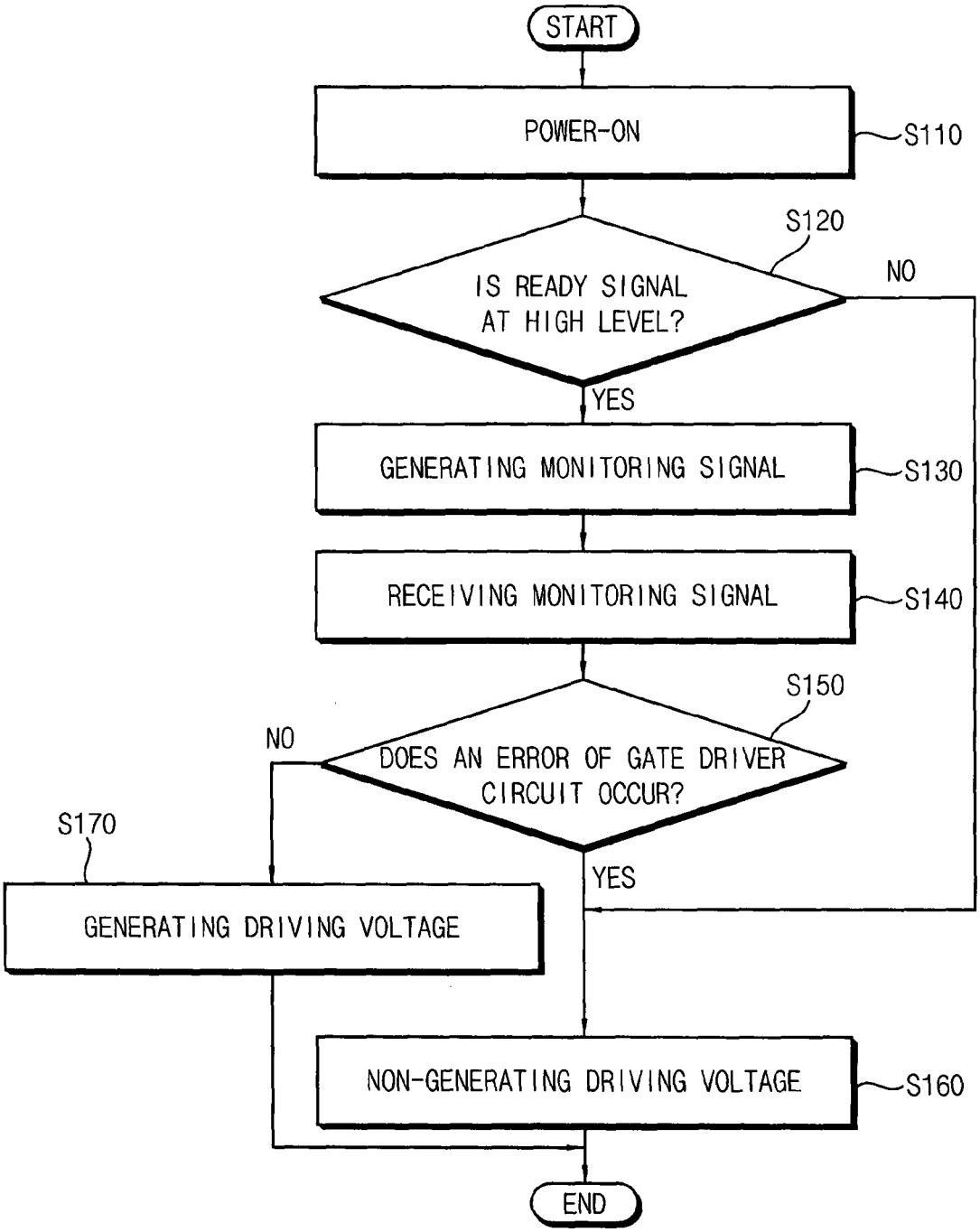
FIG. 2 is a flowchart illustrating an exemplary embodiment of a method of controlling a driving voltage by the display apparatus of FIG. 1.

FIG. 2 is a flowchart illustrating an exemplary embodiment of a method of controlling a driving voltage by the display apparatus of FIG. 1.

Referring to FIGS. 1 and 2, when the display apparatus is in a power-on state (S110), the timing control circuit 410 provides the power management circuit 430 with the ready signal in the high level through the ready signal line RDL. The ready signal in the high level is transferred to the power management circuit 430 through the plurality of circuit connection members 310 and 320 in a regular sequence (S120).

When the power management circuit 430 receives the ready signal in the high level, the power management circuit 430 generates the first and second monitoring signal to detect whether the error of the first and second gate driver circuits 110 and 120 occurs (S130). The first and second monitoring signal may be the clock signal to drive the first and second gate driver circuits 110 and 120.

The first monitoring signal is transferred to the first gate driver circuit 110 through the first monitoring signal line MTL1, which passes through the first circuit connection member 310, the first circuit board 210 and the first data connection member 141, from the power management circuit 430. Then, the first monitoring signal fed back from the first gate driver circuit 110 is transferred to the power management circuit 430 through the second monitoring signal line MTL2, which passes through the first data connection member 141, the first circuit board 210 and the first circuit connection member 310, from the first gate driver circuit 110.

As described above, in such an embodiment, the second monitoring signal is transferred to the second gate driver circuit 120 through the third monitoring signal line MTL3, which passes through the second circuit connection member 320, the second circuit board 220 and the second data connection member 142, from the power management circuit 430. Then, the second monitoring signal fed back from the second gate driver circuit 120 is transferred to the power management circuit 430 through the fourth monitoring signal line MTL4, which passes through the second data connection member 142, the second circuit board 220 and the second circuit connection member 320, from the second gate driver circuit 120.

Accordingly, in such an embodiment, the power management circuit 430 receives the first and second monitoring signals fed back from the first and second gate driver circuits 110 and 120 (S140).

The power management circuit 430 determines whether an error of the first and second monitoring signals occurs, and thus determines whether an error of the first and second gate driver circuits 110 and 120 occurs (S150).

In an exemplary embodiment, when an error is detected in at least one of the first and second monitoring signals, the power management circuit 430 stops an operation thereof. Thus, the power management circuit 430 does not generate the plurality of driving voltages (S160), such that the clock signal generated by the driving voltages is not generated, and the display apparatus is thereby in a turn-off state.

In such an embodiment, when no error is detected in the first and second monitoring signals, the power management circuit 430 drives normally. Thus, the power management circuit 430 generates a plurality of driving voltages (S170). Accordingly, the clock signal is generated by the driving voltages such that the gate driver circuit drives using the clock signal that is driving signal. Therefore, the display apparatus is in a turn-on state.

In such an embodiment, when the power management circuit 430 receives the ready signal in the low level (S120), the power management circuit 430 does not generate the plurality of driving voltages to drive the display apparatus (S160), and the display apparatus is thereby in the turn-off state.

As described above, in an exemplary embodiment, a connection state between the main circuit board 400 and the circuit connection members 310 and 320 may be detected using the ready signal, and then only when the connection state is a normal state, a process for detecting the error of the gate driver circuit is performed. Thus, when the connection state is an abnormal state, the process for detecting the error of the gate driver circuit is not performed such that the gate driver circuit may be effectively prevented from being damaged by performing the process for detecting the error in the abnormal state.

Figure 3:
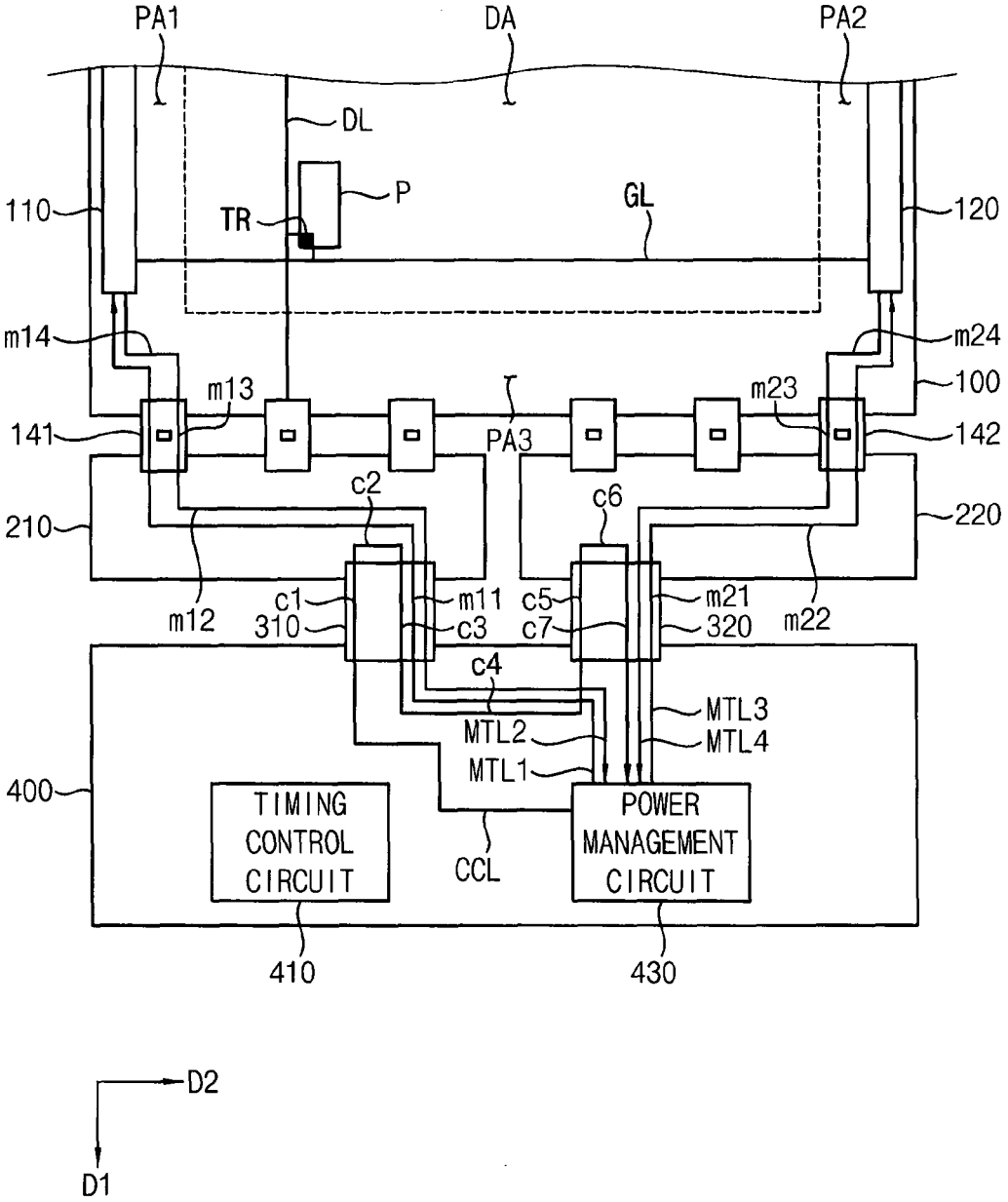
FIG. 3 is a block diagram illustrating an alternative exemplary embodiment of a display apparatus according to the invention.

FIG. 3 is a block diagram illustrating an alternative exemplary embodiment of a display apparatus according to the invention.

The display apparatus shown in FIG. 3 is substantially the same as the display apparatus shown in FIG. 1 except for the main circuit board 400. The same or like elements shown in FIG. 3 have been labeled with the same reference characters as used above to describe the exemplary embodiment of the display apparatus shown in FIG. 1, and any repetitive detailed description thereof will hereinafter be omitted or simplified.

Referring to FIG. 3, an exemplary embodiment of the display apparatus may include a display panel 100, a plurality of data connection members 141 and 142, a plurality of circuit boards 210 and 220, a plurality of circuit connection members 310 and 320 and a main circuit board 400.

In an exemplary embodiment, the display panel 100 may include a display area DA and a plurality of peripheral areas PA1, PA2 and PA3 surrounding the display area DA.

In such an embodiment, a plurality of data lines DL, a plurality of gate lines GL and a plurality of pixels P are disposed in the display area DA.

The display panel 100 may include a first gate driver circuit 110 disposed in or integrated on a first peripheral area PA1.

The display panel 100 may include a second gate driver circuit 120 disposed in or integrated on a second peripheral area PA2.

The display panel 100 may include a plurality of data connection members 141 and 142 disposed in a third peripheral area PA3.

The plurality of data connection members 141 and 142 is configured to provide the data lines DL with a plurality of data signals.

The plurality of circuit connection members 310 and 320 is connected to the plurality of circuit boards 210 and 220. The plurality of circuit connection members 310 and 320 includes a first circuit connection member 310 connected to the first circuit board 210 and a second circuit connection member 320 connected to the second circuit board 220.

The main circuit board 400 includes a timing control circuit 410 and a power management circuit 430 which are disposed therein.

The timing control circuit 410 generally controls a driving timing of the display apparatus.

The power management circuit 430 is configured to generate a plurality of driving voltages. In such an embodiment, the power management circuit 430 is configured to generate a plurality of clock signals which controls the first and second gate driver circuits 110 and 120.

The power management circuit 430 is configured to generate a connection detection signal in a high level, which is a signal for detecting a connection state between the plurality of circuit connection members 310 and 320 and the main circuit board 400. The connection detection signal is transferred through a connection detection signal line CCL.

In an exemplary embodiment, the connection detection signal line CCL includes a first portion c1 which passes through a first area of connection areas of the first circuit connection member 310, a second portion c2 which is disposed in a first area of the first circuit board 210, a third portion c3 which passes through a second area of the connection areas of the first circuit connection member 310, a fourth portion c4 which is disposed in a first area of the main circuit board 400, a fifth portion c5 which passes through a first area of connection areas of the second circuit connection member 320, a sixth portion c6 which is disposed in a first area of the second circuit board 220 and a seventh portion c7 which passes through a second area of the connection areas of the second circuit connection member 320. As described above, in such an embodiment, the connection detection signal line CCL passes through all connection areas of the first and second circuit connection members 310 and 320. In such an embodiment, the connection area of the first or second circuit connection member 310 or 320 may be defined at opposing ends thereof.

When the connection detection signal in a high level is received at the power management circuit 430 through the connection detection signal line CCL, the power management circuit 430 substantially performs an operation thereof. Thus, the power management circuit 430 generates a plurality of driving voltages and the plurality of clock signals using the plurality of driving voltages. In such an embodiment, when the connection detection signal in a low level is received at the power management circuit 430 through the connection detection signal line CCL, the power management circuit 430 substantially does not perform the operation, such that the power management circuit 430 does not generate the plurality of driving voltages and the plurality of clock signals.

The power management circuit 430 is configured to generate a first monitoring signal, which is a signal for detecting an error of the first gate driver circuit 110 and to generate second monitoring signal, which is a signal for detecting an error of the second gate driver circuit 120. In an exemplary embodiment, a clock signal may function as the first and second monitoring signals.

The power management circuit 430 is configured to provide the first and second gate driver circuits 110 and 120 with the first and second monitoring signals during an error detection period, and then to receive the first and second monitoring signals fed back from the first and second gate driver circuits 110 and 120 and to thereby determine whether an error occurs in the first and second gate driver circuits 110 and 120.

In an exemplary embodiment, as described above, the power management circuit 430 may detect whether a connection error occurs between the main circuit board 400 and the circuit connection members 310 and 320, using the connection detection signal generated from the power management circuit 430.

Figure 4:
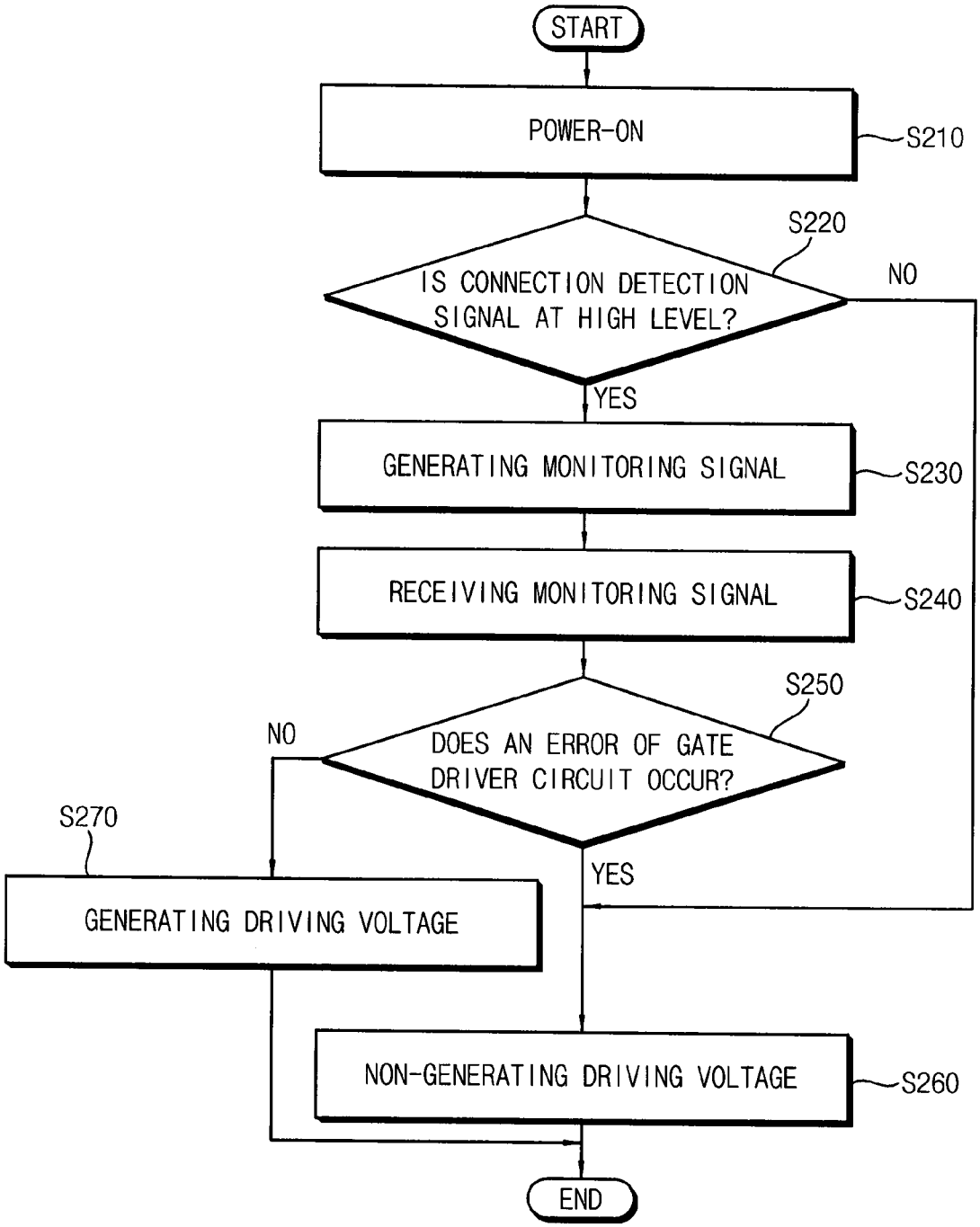
FIG. 4 is a flowchart illustrating an exemplary embodiment of a method of controlling a driving voltage by the display apparatus of FIG. 3.

FIG. 4 is a flowchart illustrating an exemplary embodiment of a method of controlling a driving voltage by the display apparatus of FIG. 3.

Referring to FIGS. 3 and 4, when the display apparatus is in a power-on state (S210), the power management circuit 430 generates and outputs the connection detection signal in the high level and then receives the connection detection signal output therefrom through the connection detection signal line CCL which passes through the plurality of circuit connection members 310 and 320 (S220).

When the power management circuit 430 receives the connection detection signal in the high level, the power management circuit 430 generates the first and second monitoring signal to detect whether the error of the first and second gate driver circuits 110 and 120 occurs (S230). The first and second monitoring signal may be the clock signal to drive the first and second gate driver circuits 110 and 120.

The power management circuit 430 receives the first and second monitoring signals fed back from the first and second gate driver circuits 110 and 120 (S240).

The power management circuit 430 determines whether an error of the first and second monitoring signals occurs, to determine whether an error of the first and second gate driver circuits 110 and 120 occurs (S250).

When an error is detected in at least one of the first and second monitoring signals, the power management circuit 430 stops an operation thereof. Thus, the power management circuit 430 does not generate the plurality of driving voltages (S260). Accordingly, the clock signal generated by the driving voltages is not generated, and the display apparatus thereby becomes a turn-off state.

When no error is detected in the first and second monitoring signals, the power management circuit 430 generates a plurality of driving voltages (S270). Accordingly, the clock signal is generated by the driving voltages such that the gate driver circuit drives using the clock signal that is driving signal. Therefore, the display apparatus becomes a turn-on state.

In such an embodiment, when the power management circuit 430 receives the connection detection signal in the low level (S220), the power management circuit 430 does not generate the plurality of driving voltages (S260). Therefore, the display apparatus becomes the turn-off state.

As described above, in an exemplary embodiment, a connection state between the main circuit board 400 and the circuit connection members 310 and 320 may be detected using the connection detection signal, and a process for detecting the error of the gate driver circuit is performed only when the connection state is in a normal state. Thus, in such an embodiment, when the connection state is in an abnormal state, the process for detecting the error of the gate driver circuit is not performed such that the gate driver circuit may be effectively prevented from being damaged by performing the process for detecting the error in the abnormal state.

Figure 5:
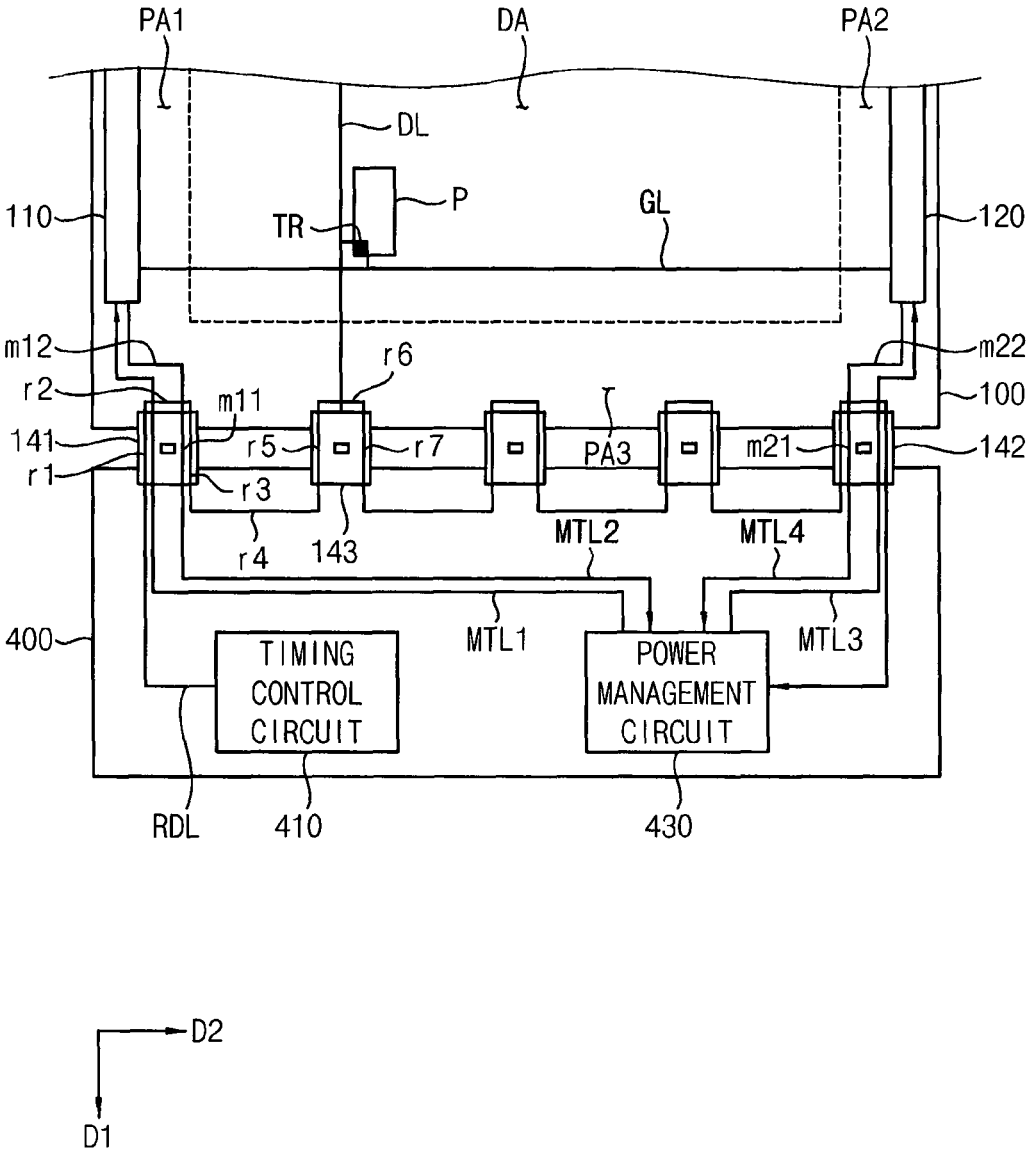
FIG. 5 is a block diagram illustrating another alternative exemplary embodiment of a display apparatus according to the invention.

FIG. 5 is a block diagram illustrating another alternative exemplary embodiment of a display apparatus according to the invention.

The display apparatus shown in FIG. 5 is substantially the same as the display apparatus shown in FIG. 1 except that the circuit board and the circuit connection member are omitted. The same or like elements shown in FIG. 5 have been labeled with the same reference characters as used above to describe the exemplary embodiment of the display apparatus shown in FIG. 1, and any repetitive detailed description thereof will hereinafter be omitted or simplified.

Referring to FIG. 5, an exemplary embodiment of the display apparatus may include a display panel 100, a plurality of data connection members 141, 142 and 143 and a main circuit board 400.

The display panel 100 may include a display area DA and a plurality of peripheral areas PA1, PA2 and PA3 surrounding the display area DA.

The display panel 100 may include a plurality of data lines DL, a plurality of gate lines GL and a plurality of pixels P, which are disposed in the display area DA.

The display apparatus may include a first gate driver circuit 110 disposed in or integrated on a first peripheral area PA1 of the display panel 100.

The display apparatus may include a second gate driver circuit 120 disposed in or integrated on a second peripheral area PA2 of the display panel 100.

The display apparatus may include a plurality of data connection members 141, 142 and 143 disposed in a third peripheral area PA3 of the display panel 100.

The main circuit board 400 includes a timing control circuit 410 and a power management circuit 430 which are disposed therein.

When the display apparatus is in a power-on state, the timing control circuit 410 is configured to provide the power management circuit 430 with ready signal in a high level to inform a ready state for an operation thereof. The ready signal is transferred to the power management circuit 430 through a ready signal line RDL.

In an exemplary embodiment, the ready signal line RDL includes a first portion r1 which passes through a first area of connection areas of the first data connection member 141, a second portion r2 which is disposed in the third peripheral area PA3, a third portion r3 which passes through a second area of the connection areas of the first data connection member 141, a fourth portion r4 which is disposed in a first area of the main circuit board 400, a fifth portion r5 which passes through a first area of connection areas of a third data connection member 143 adjacent to the first data connection member 141, a sixth portion r6 which is disposed in the third peripheral area PA3 and a seventh portion r7 which passes through a second area of the connection areas of the third data connection member 143. As described above, the ready signal line RDL extends from the timing control circuit 410 to the power management circuit 430 through the plurality of data connection members. The ready signal line RDL passes through all connection areas of the plurality of data connection members. In such an embodiment, the connection areas of the first or third data connection member 141 or 143 may be defined at opposing ends thereof.

When the ready signal in the high level is received at the power management circuit 430, the power management circuit 430 substantially performs an operation thereof. Thus, the power management circuit 430 generates a plurality of driving voltages and then generates the plurality of clock signals using the plurality of driving voltages. However, when the ready signal in a low level is received at the power management circuit 430, the power management circuit 430 does not generate the plurality of driving voltages.

The power management circuit 430 is configured to provide the first and second gate driver circuits 110 and 120 with the first and second monitoring signals during an error detection period, and then to receive the first and second monitoring signals fed back from the first and second gate driver circuits 110 and 120 and to thereby determine whether an error occurs in the first and second gate driver circuits 110 and 120.

As described above, in such an embodiment, the power management circuit 430 may detect whether a connection error occurs between the plurality of data connection members 141, 142 and 143, and the main circuit board 400, using the ready signal generated from the timing control circuit 410.

A method of controlling a driving voltage by the display apparatus shown in FIG. 5 is substantially the same as the exemplary embodiment of the method shown in FIG. 2, and any repetitive detailed description thereof will be omitted.

Figure 6:
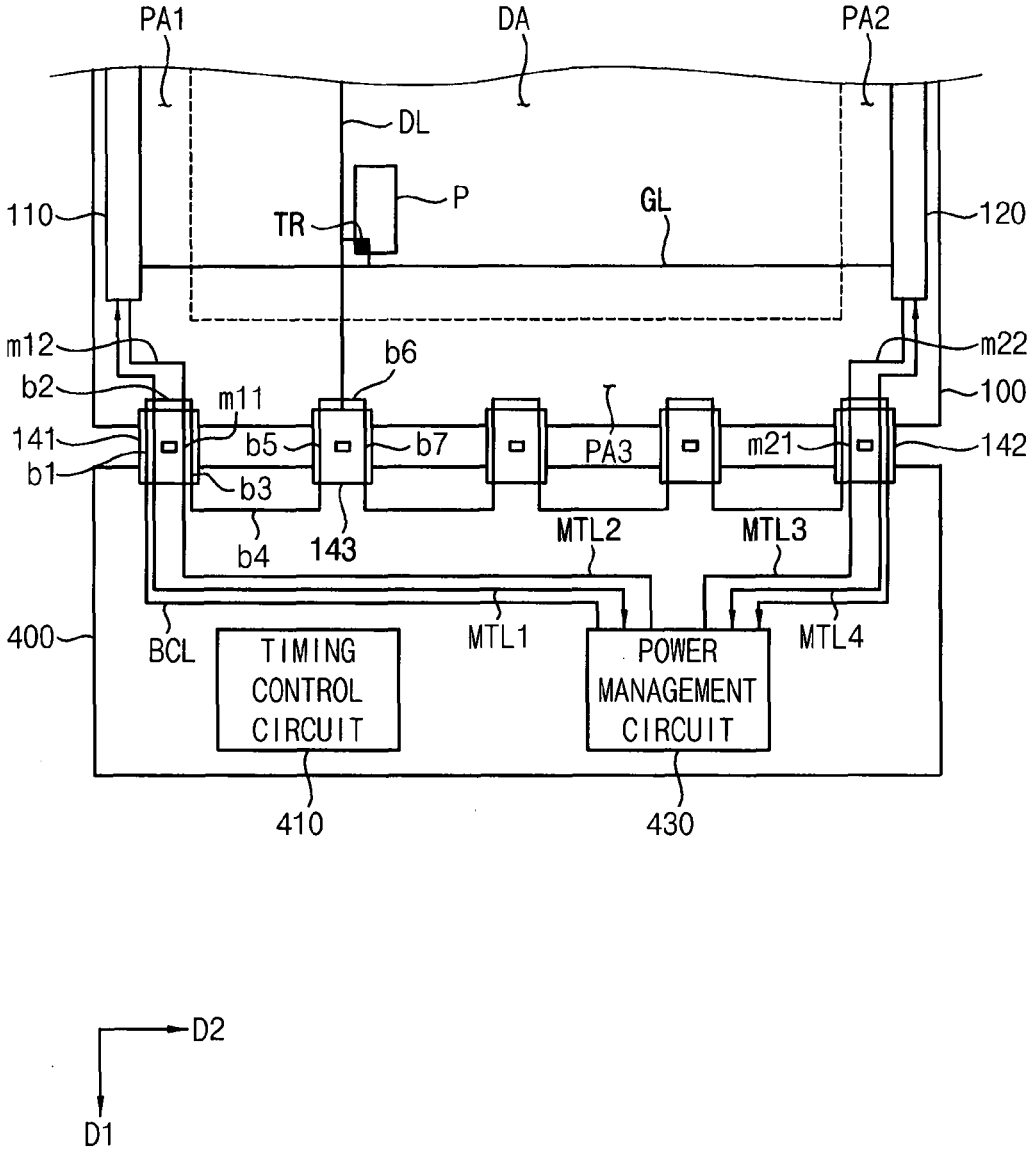
FIG. 6 is a block diagram illustrating another alternative exemplary embodiment of a display apparatus according to the invention.

FIG. 6 is a block diagram illustrating another alternative exemplary embodiment of a display apparatus according to the invention.

The display apparatus shown in FIG. 6 is substantially the same as the display apparatus shown in FIG. 5 except that a connection state between a data connection member and a main circuit board is detected using a connection detection signal which is generated from a power management circuit. The same or like elements shown in FIG. 6 have been labeled with the same reference characters as used above to describe the exemplary embodiment of the display apparatus shown in FIG. 5, and any repetitive detailed description thereof will hereinafter be omitted or simplified.

Referring to FIG. 6, an exemplary embodiment of the display apparatus may include a display panel 100, a plurality of data connection members 141, 142 and 143 and a main circuit board 400.

The display panel 100 may include a display area DA and a plurality of peripheral areas PA1, PA2 and PA3 surrounding the display area DA.

The display panel 100 may include a plurality of data lines DL, a plurality of gate lines GL and a plurality of pixels P, which are disposed in the display area DA.

The display apparatus may include a first gate driver circuit 110 disposed in or integrated on a first peripheral area PA1 of the display panel 100.

The display apparatus may include a second gate driver circuit 120 disposed in or integrated on a second peripheral area PA2 of the display panel 100.

The display apparatus may include a plurality of data connection members 141, 142 and 143 disposed in a third peripheral area PA3 of the display panel 100.

The main circuit board 400 includes a timing control circuit 410 and a power management circuit 430 which are disposed therein.

The timing control circuit 410 is configured to generally control a driving timing of the display apparatus.

The power management circuit 430 is configured to generate a plurality of driving voltages, and the power management circuit 430 is configured to generate a plurality of clock signals which controls the first and second gate driver circuits 110 and 120.

The power management circuit 430 is configured to generate a connection detection signal in a high level, which is a signal for detecting a connection state between the plurality of circuit connection members 310 and 320 and the main circuit board 400. The connection detection signal is transferred through a connection detection signal line BCL.

In an exemplary embodiment, the connection detection signal line BCL includes a first portion b1 which passes through a first area of connection areas of the first data connection member 141, a second portion b2 which is disposed in the third peripheral area PA3, a third portion b3 which passes through a second area of the connection areas of the first data connection member 141, a fourth portion b4 which is disposed in a first area of the main circuit board 400, a fifth portion b5 which passes through a first area of connection areas of a third data connection member 143 adjacent to first data connection member 141, a sixth portion b6 which is disposed in the third peripheral area PA3 and a seventh portion b7 which passes through a second area of the connection areas of the third data connection member 143. The connection detection signal line BCL passes through all connection areas of the plurality of data connection members. In such an embodiment, the connection areas of the first or third data connection member 141 or 143 may be defined at opposing ends thereof.

As described above, in such an embodiment, the connection detection signal is outputted from the power management circuit 430 and then fed back into the power management circuit 430 through connection detection signal line BCL which passes through the plurality of data connection members.

When the connection detection signal in the high level is received at the power management circuit 430, the power management circuit 430 substantially performs an operation thereof. Thus, the power management circuit 430 generates a plurality of driving voltages and then the plurality of clock signals using the plurality of driving voltages. However, when the connection detection signal in a low level is received at the power management circuit 430, the power management circuit 430 does not generate the plurality of driving voltages.

The power management circuit 430 is configured to provide the first and second gate driver circuits 110 and 120 with the first and second monitoring signals during an error detection period, and then to receive the first and second monitoring signals fed back from the first and second gate driver circuits 110 and 120 and to thereby detect whether an error occurs in the first and second gate driver circuits 110 and 120.

As described above, in such an embodiment, the power management circuit 430 may detect whether a connection error occurs between the plurality of data connection members 141, 142 and 143 and the main circuit board 400, using the connection detection signal generated from the power management circuit 430.

A method of controlling a driving voltage by the display apparatus shown in FIG. 6 is substantially the same as the exemplary embodiment of the method shown in FIG. 4 and any repetitive detailed description thereof will be omitted.

According to exemplary embodiments of the invention as set forth herein, a connection state between the main circuit board, the connection member and the data connection member may be detected using a predetermined signal, and a process for detecting the error of the gate driver circuit is performed only when the connection state is in a normal state. Thus, when the connection state is in an abnormal state, the process for detecting the error of the gate driver circuit is not performed such that the gate driver circuit may be effectively prevented from being damaged by performing the process for detecting the error in the abnormal state.

The foregoing is illustrative of the invention and is not to be construed as limiting thereof. Although a few exemplary embodiments of the invention have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. Therefore, it is to be understood that the foregoing is illustrative of the invention and is not to be construed as limited to the specific exemplary embodiments disclosed, and that modifications to the disclosed exemplary embodiments, as well as other exemplary embodiments, are intended to be included within the scope of the appended claims. The invention is defined by the following claims, with equivalents of the claims to be included therein.

What is claimed is:

1. A method of controlling a driving voltage of a display apparatus, the method comprises:

transmitting a ready signal from a timing control circuit of the display apparatus to a power management circuit of the display apparatus through a ready signal line passing a connection area of a connection member of the display apparatus, which is disposed between a display panel and a main circuit board of the display apparatus; and controlling a generation of the driving voltage from the power management circuit based on the ready signal received by the power management circuit, wherein the display apparatus comprises a gate driver circuit disposed on the display panel, and the ready signal line directly connects the timing control circuit disposed on the main circuit board and the power management circuit disposed on the main circuit board.

2. The method of claim 1, further comprising:

generating the driving voltage from the power management circuit during an error detection period when the ready signal received by the power management circuit is in a high level; and generating a clock signal of the gate driver circuit from the power management circuit using the driving voltage.

3. The method of claim 2, further comprising:

providing the gate driver circuit with the clock signal;

feeding back the clock signal to the power management circuit from the gate driver circuit;

determining whether an error occurs in the gate drive circuit using the clock signal fed back to the power management circuit; and controlling the generation of the driving voltage from the power management circuit based on a determination on whether the error occurs.

4. The method of claim 2, further comprising:

non-generating the driving voltage from the power management circuit, when the ready signal received by the power management circuit is in a low level.

5. The method of claim 2, wherein the display apparatus further comprises:

a data connection member which is connected to the display panel and is configured to generate a data signal;

a circuit board which is connected to the data connection member; and a circuit connection member which is connected to the circuit board and the main circuit board, wherein the ready signal passes through a connection area of the circuit connection member.

6. The method of claim 2, wherein the display apparatus further comprises:

a data connection member which connects the display panel and the main circuit board and is configured to generate a data signal, wherein the ready signal passes through a connection area of the data connection member.

7. A method of controlling a driving voltage of a display apparatus, the method comprises:

generating a connection detection signal from a main circuit board of the display apparatus;

transmitting the connection detection signal from a power management circuit of the display apparatus to the power management circuit of the display apparatus through a connection area of a connection member which is disposed between a display panel and the main circuit board of the display apparatus; and controlling a generation of the driving voltage from the power management circuit based on the connection detection signal received by the power management circuit, wherein the display apparatus comprises a gate driver circuit disposed on the display panel, and the power management circuit is disposed on the main circuit board.

8. The method of claim 7, further comprising:

generating the driving voltage from the power management circuit during an error detection period when the connection detection signal received by the power management circuit is in a high level; and generating a clock signal of the gate driver circuit from the power management circuit using the driving voltage.

9. The method of claim 8, further comprising:

providing the gate driver circuit with the clock signal;

feeding back the clock signal to the power management circuit from the gate driver circuit;

determining whether an error occurs in the gate drive circuit using the clock signal fed back to the power management circuit; and controlling the generation of the driving voltage based on a determination on whether the error occurs.

10. The method of claim 8, further comprising:

non-generating the driving voltage, when the connection detection signal received by the power management circuit is in a low level.

11. A display apparatus comprising:

a display panel;

a gate driver circuit disposed on the display panel;

a main circuit board comprising:

a timing control circuit which is disposed therein, wherein the timing control circuit generates a ready signal; and a power management circuit disposed therein, wherein the power management circuit generates a driving voltage to drive the display panel; and a connection member disposed between the display panel and the main circuit board, wherein the power management circuit receives the ready signal from the timing control circuit through a ready signal line passing a connection area of the connection member and directly connecting the timing control circuit and the power management circuit and controls a generation of the driving voltage based on the ready signal received thereby.

12. The display apparatus of claim 11, wherein when the ready signal received by the power management circuit is in a high level during an error detection period, the power management circuit generates the driving voltage and generates a clock signal of the gate driver circuit using the driving voltage.

13. The display apparatus of claim 12, wherein the power management circuit provides the gate driver circuit with the clock signal, feeds back the clock signal from the gate driver circuit, determines whether an error occurs in the gate drive circuit using the clock signal fed back thereto, and controls the generation of the driving voltage based on a determination on whether the error occurs.

14. The display apparatus of claim 12, wherein the power management circuit generates the driving voltage, when the ready signal received by the power management circuit is in a low level.

15. The display apparatus of claim 12, further comprising:

a data connection member which is connected to the display panel and is configured to generate a data signal;

a circuit board which is connected to the data connection member; and a circuit connection member which is connected to the circuit board and the main circuit board, wherein the ready signal passes through a connection area of the circuit connection member.

16. The display apparatus of claim 12, further comprising:

a data connection member which connects the display panel and the main circuit board and is configured to generate a data signal, wherein the ready signal passes through a connection area of the data connection member.

17. A display apparatus comprising:

a display panel;

a gate driver circuit disposed on the display panel;

a main circuit board comprising a power management circuit disposed therein; and a connection member disposed between the display panel and the main circuit board, wherein the power management circuit generates a driving voltage to drive the display panel and a connection detection signal, transmits the connection detection signal from the power management circuit to the power management circuit through a connection area of the connection member and controls a generation of the driving voltage based on the connection detection signal received thereby.

18. The display apparatus of claim 17, wherein when the connection detection signal received by the power management circuit is in a high level during an error detection period, the power management circuit generates the driving voltage and generates a clock signal of the gate driver circuit using the driving voltage.

19. The display apparatus of claim 18, wherein the power management circuit provides the gate driver circuit with the clock signal, feeds back the clock signal from the gate driver circuit, determine whether an error occurs in the gate drive circuit using the clock signal fed back thereto, and controls the generation of the driving voltage based on a determination on whether the error occurs.

20. The display apparatus of claim 18, wherein the power management circuit does not generate the driving voltage when the connection detection signal received by the power management circuit is in a low level.

* * * * *